United States Patent [19]

McCann et al.

[11] Patent Number: 5,048,726

[45] Date of Patent: Sep. 17, 1991

[54] SUPERFLOW DIFFUSER AND SPOUT ASSEMBLY

[75] Inventors: Gerald P. McCann, Los Angeles; Eugene R. Kief, Saugus, both of Calif.

[73] Assignee: McCann's Engineering And Manufacturing Co., Los Angeles, Calif.

[21] Appl. No.: 525,924

[22] Filed: May 18, 1990

Related U.S. Application Data

[63] Continuation-in-part of Ser. No. 374,088, Jun. 30, 1989, Pat. No. 4,986,447, which is a continuation-in-part of Ser. No. 195,947, May 19, 1988, Pat. No. 4,928,854.

[51] Int. Cl.[5] ..... B67D 5/56

[52] U.S. Cl. ..... 222/129.1; 222/148; 239/424; 239/426; 239/434

[58] Field of Search ..... 222/129.1–129.4, 222/148, 145, 564; 239/419, 424, 424.5, 425, 426, 427.3, 434, 106

[56] References Cited

U.S. PATENT DOCUMENTS

| | | | |
|---|---|---|---|
| 1,329,601 | 2/1920 | Hinsdale | 239/106 |
| 3,423,028 | 1/1969 | Stupakis | 239/419.3 |
| 3,622,081 | 11/1971 | Marsh | 239/427.3 |
| 3,717,284 | 2/1973 | Garrard | 222/129.1 |
| 3,898,861 | 8/1975 | McMillin | 222/148 |
| 3,966,091 | 6/1976 | Bencic | 222/129.1 |
| 4,218,014 | 8/1980 | Tracy | 239/106 |
| 4,270,673 | 6/1981 | Rodth | 222/129.1 |
| 4,765,513 | 8/1988 | McMillin et al. | 222/148 |
| 4,903,862 | 2/1990 | Shannon et al. | 222/129.1 X |
| 4,928,854 | 5/1990 | McCann et al. | 222/129.1 X |
| 4,986,447 | 1/1991 | McCann et al. | 222/129.1 |
| 4,993,601 | 2/1991 | Nakayama et al. | 222/129.1 X |

*Primary Examiner*—Michael S. Huppert
*Assistant Examiner*—Gregory L. Huson
*Attorney, Agent, or Firm*—Lyon & Lyon

[57] ABSTRACT

A superflow diffuser and spout assembly includes an inlet for carbonated water, an inlet for syrup, a diffuser assembly through which the carbonated water passes prior to being dispensed, a spout, a syrup distributor, and a flow separator within the path of the carbonated water. An embodiment herein includes a channel about the inner periphery of the spout wall to distribute syrup to holes passing through the wall of the spout. The syrup is thus mixed with the diluent flow outside of the spout.

3 Claims, 4 Drawing Sheets

SUPERFLOW DIFFUSER AND SPOUT ASSEMBLY

CROSS-REFERENCE TO RELATED APPLICATION

This application is a continuation-in-part of copending application, Ser. No. 374,088 now U.S. Pat. No. 4,986,447, filed Jun. 30, 1989, entitled "Superflow Diffuser and Spout Assembly", which is a continuation-in-part of co-pending application, Ser. No. 195,947, filed May 19, 1988, now U.S. Pat. No. 4,928,854, issued May 19, 1990 entitled "Superflow Diffuser and Spout Assembly".

FIELD OF THE INVENTION

This field of the present invention is diffusers and spout assemblies, and, in particular, diffusers and spout assemblies which are useful for the to dispensing of carbonated drinking liquids, such as soft drinks.

BACKGROUND OF THE INVENTION

In the vending machine and soft drink dispensing industry it is well known that a basic problem exists with regard to increasing the flow rate of dispensed liquids above the standard one and one-half to three ounces per second. This basic problem manifests itself in excessive foaming of the drink, which causes spillage and overflow. In addition, excessive foaming reduces the efficiency of the operator responsible for dispensing the drinks, because excessive foaming requires the operator to terminate the filling cycle early to permit foam reduction, then re-initiate the filling cycle to "top off" the drink.

Nevertheless, it is desirable that flow rates be maximized to reduce the time required to dispense the soft drink, thus providing improved customer service or reducing the number of attendants required at the work station. Increased flow rate drink dispensers are particularly desirable at high-volume operations such as movie theaters and amusement parks.

Conventional diffusers and spouts used with existing dispensing equipment do not function well when scaled up to flow rates of 5 ounces per second or more. Using conventional equipment, when the flow rate is increased to in excess of 3 ounces per second undesirable hissing occurs at the spout or excessive foaming results from the mixing that occurs between the carbonated water and the syrup. Furthermore, at high flow rates the quality of the drink is known to decrease because of stratification of the syrup or excessive loss of carbon dioxide.

It is known that high pressure carbonated water, typically in the range of 60–120 PSIG, used with conventional dispensing equipment, must gently be reduced to atmospheric pressure so as to lose a minimum of carbon dioxide. In existing equipment the methods of pressure reduction result in excessive out-gassing of the carbon dioxide at high flow rates, thus causing excessive foaming of the drink with the attendant reduction in efficiency of the operator and waste of the product. Also, this excessive out-gassing results in a "flat" drink.

Various methods have been previously devised to reduce foaming of the drink, yet attempt to maintain the quality of the drink. The most conventional method to reduce foaming of the drink is to provide a restricted passage in the flow, thus reducing the velocity of the carbonated water. However, by placing a restriction in the line, the flow rate is substantially reduced to undesirable levels. In other dispensing devices a coiled feed line is provided to reduce foaming of the dispensed soft drink. Alternatively, it is possible to provide a series of chambers which are operative to reduce the pressure of carbon dioxide in the water at various stages in the diffuser and spout assembly. However, this approach has led to an excessive out-gassing of the carbon dioxide, thus resulting in an undesirable reduction in the quality of the dispensed drink.

Existing diffusers and spout assemblies normally contain an inlet for the carbonated water and an inlet for the syrup. These inlets open into chambers which eventually meet at a common mixing chamber. The common mixing chamber opens into a spout for dispensing of the carbonated water/syrup mixture. A pressure reduction occurs at the first chamber, where the carbonated water or syrup is introduced, again at the mixing chamber and again at the spout. Thus, in conventional diffusers and spout assemblies pressure reduction occurs generally at only two or three locations, the result being a limitation in the potential flow rate, or if the chambers are made large enough to facilitate higher flow rates, an undesirable out-gassing of carbon dioxide from the carbonated water.

SUMMARY OF THE INVENTION

The present invention is directed to a superflow diffuser and spout assembly for use with a liquid dispensing apparatus which provides a new and improved diffuser and spout assembly capable of dispensing carbonated liquids at flow rates and uniformity of mixing in excess of those previously achieved.

In a first aspect of the present invention, a supply of carbonated water and a supply of syrup are presented to a spout assembly for mixing and dispensing. The supply of carbonated water is separated into two streams, one of which flows along the outside of the spout while the other flows through the spout. The supply of syrup is directed so as to be entrained into both streams for uniform mixing.

In a further aspect of the present invention, a syrup distribution channel is provided in association with holes located about the periphery of the spout. This arrangement properly distributes and communicates syrup to a carbonated water stream flowing about the spout.

In another aspect of the present invention, a superflow diffuser and spout assembly provide multiple stages of pressure reduction while achieving increased flow rates and maximizing carbon dioxide retention with an attendant reduction in foaming of the dispensed drink.

Accordingly, it is an object of the present invention to provide a superflow diffuser and spout assembly which achieves high levels of flow and mixing without excessive loss of carbonation and without excessive foam.

The foregoing and additional objects and features of the present invention will become apparent from the following description, in which the preferred embodiments have been set forth in detail, in conjunction with the accompanying drawings.

BRIEF DESCRIPTION OF THE DRAWINGS

FIG. 7 is a side cross-sectional view of a fourth embodiment the superflow diffuser and spout assembly of the present invention.

DESCRIPTION OF THE PREFERRED EMBODIMENT

Figure 1:
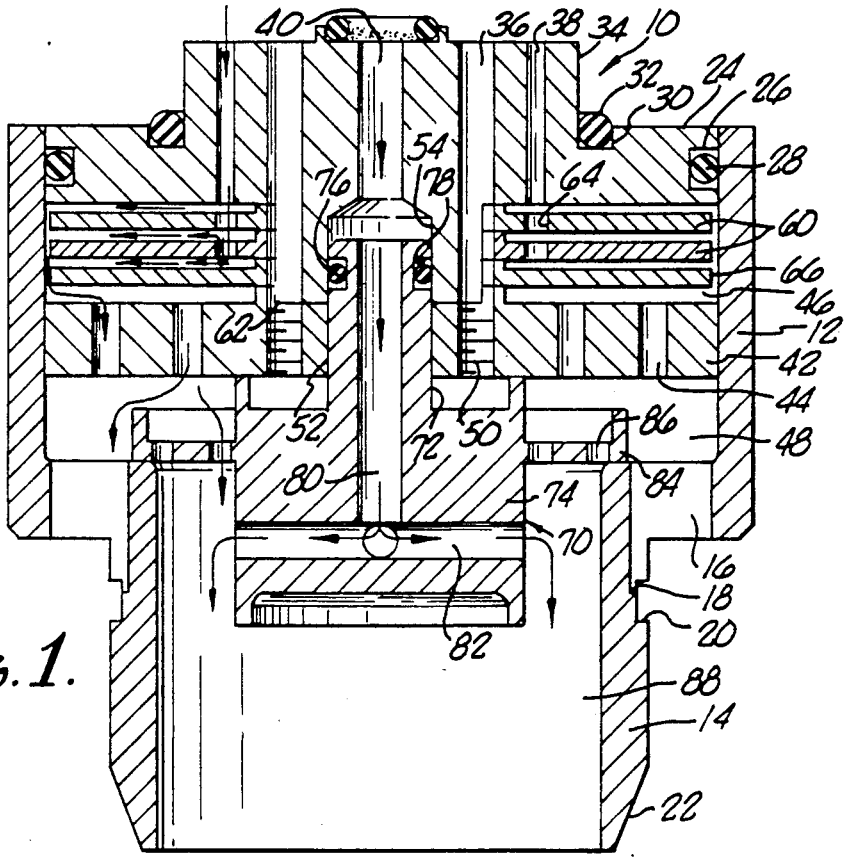
FIG. 1 is a side cross-sectional view of the superflow diffuser and spout assembly of the present invention.
Figure 2:
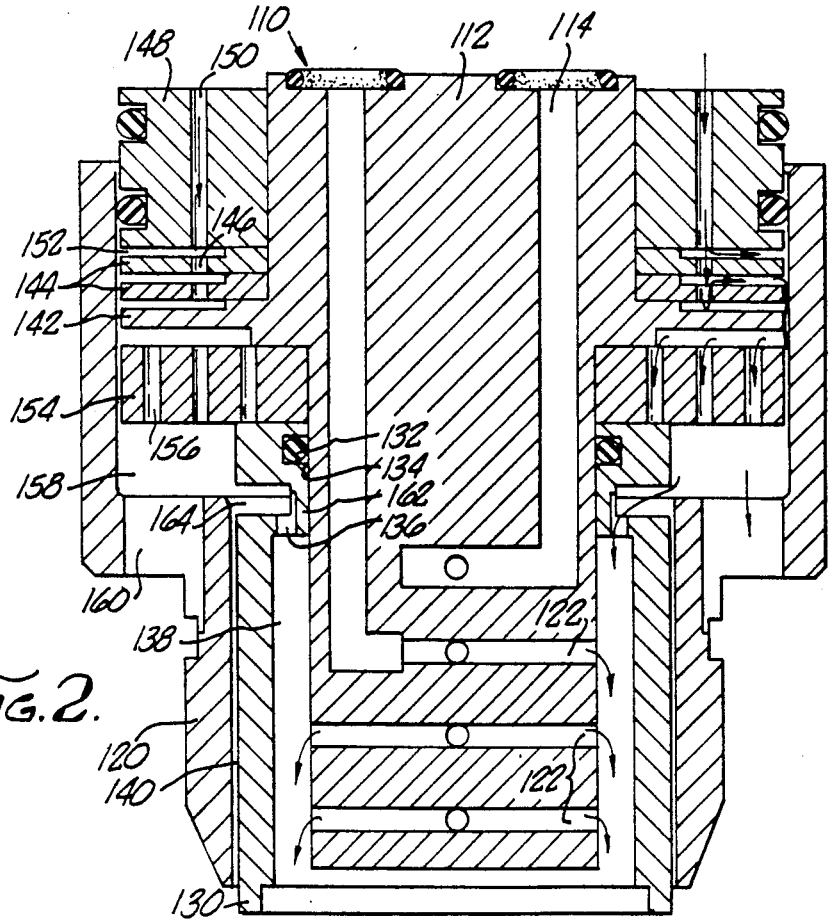
FIG. 2 is a side cross-sectional view of a second embodiment of the superflow diffuser and spout assembly of the present invention adapted to dispense syrups of different flavors.

Referring to the drawings, a superflow diffuser and spout assembly made in accordance with the present invention is shown in FIG. 1. The superflow diffuser and spout assembly 10 includes a body 12 and a spout 14. The body 12 is preferably integral with the spout 14 or the spout 14 may be a separate component attachable to the body 12. The body 12 is substantially cylindrical in shape, whereas the spout 14 is over an upper portion cylindrical in shape and over a lower portion substantially frustoconical.

The body 12 has a plurality of channels 16 formed in the lower portion of the body 12 circumferentially disposed around the spout 14. The channels 16 are positioned such that a first ridge 18 and a second ridge 20 formed along the outside wall of the spout 14 are operative to create turbulence in the liquid, as well as distribute an even flow of liquid around the entire perimeter of the spout 14 and along the outside surface of the spout 14. The purpose and importance of these ridges 18, 20 will be discussed in greater detail hereinafter in a discussion of the operation of the present invention. The spout 14 is formed such that an angled surface 22 is located at the lowermost portion of the spout 14 resulting in the substantially frustoconical configuration of the lower portion of the spout 14. The angled surface 22 directs the flow along the outside of the spout 14 into the flow passing through the inside of the spout 14 causing mixing of the two streams of liquid.

Figure 5:
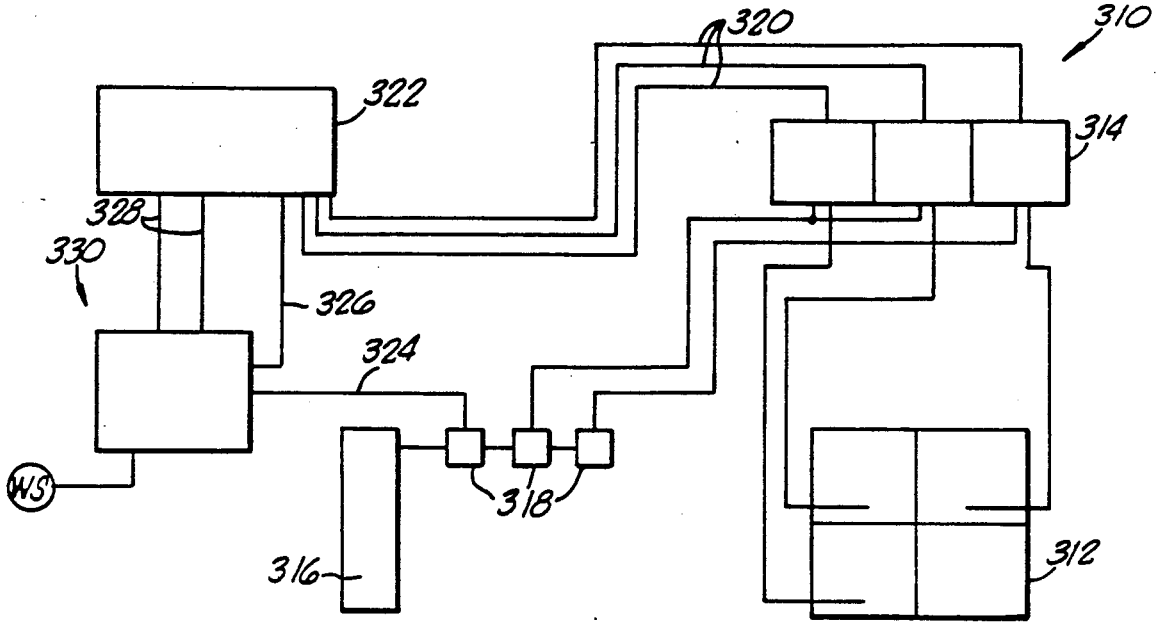
FIG. 5 is a block diagram illustrating other components of a beverage distribution system using the superflow diffuser and spout assembly of the present invention.
Figure 6:
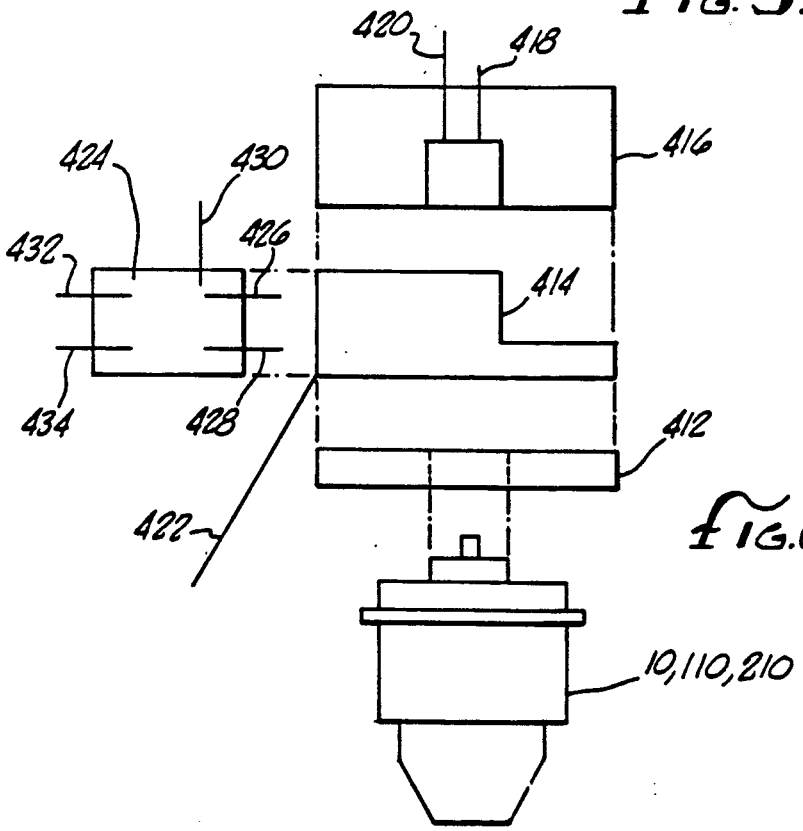
FIG. 6 is a block diagram illustrating the other components of a tower assembly using the superflow diffuser and spout assembly of the present invention.
Figure 1:
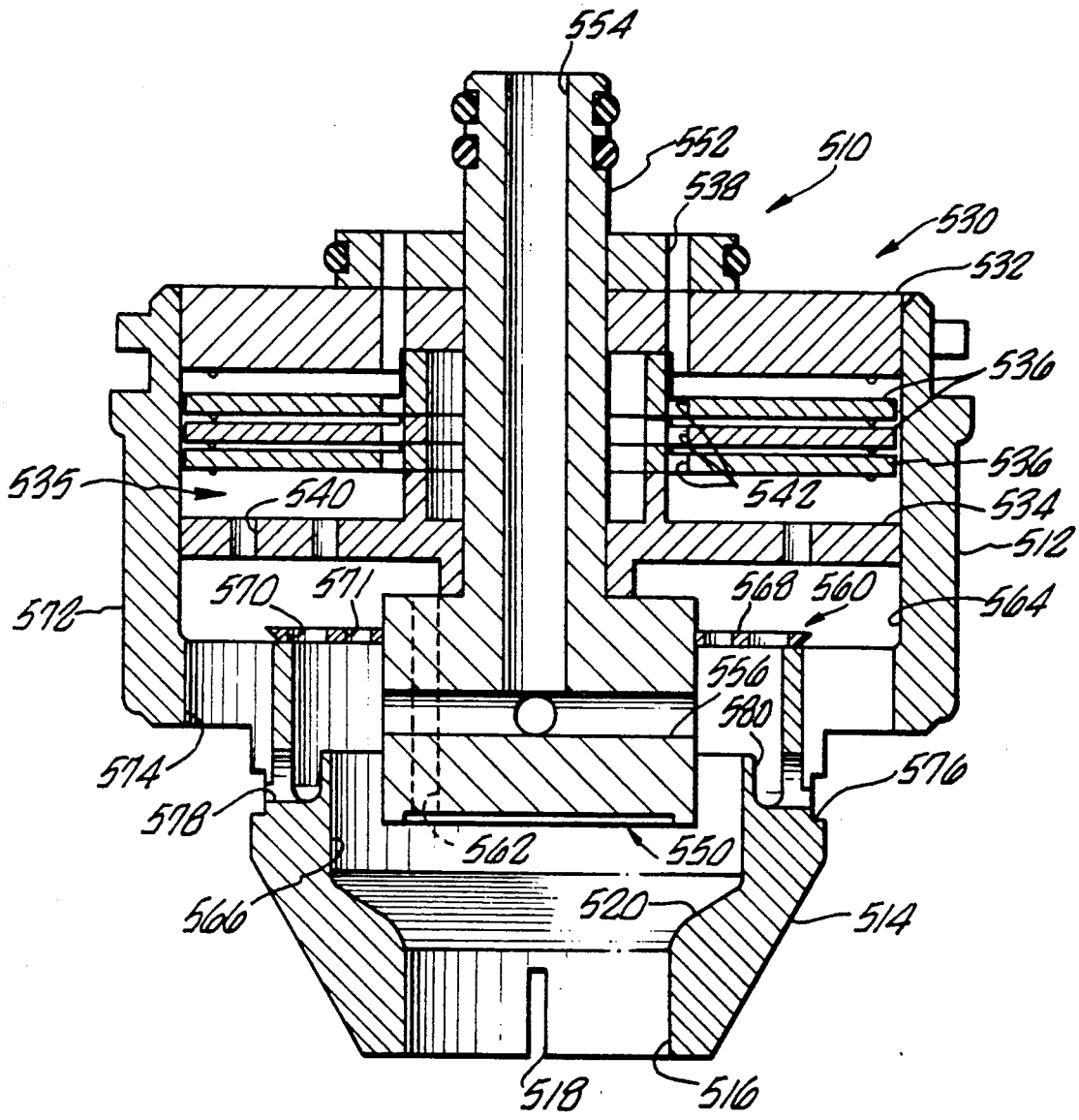

Fitted within the body 12 of the superflow diffuser and spout assembly 10 is a first disk 24 which has a groove 26 disposed about its entire periphery. The groove 26 houses an O-ring 28 to retain the first disk 24 within the body 12 and to seal the inner cavity of the body 12 from the outside environment. A second groove 30 is located along the upper surface of the disk 24 and houses a second O-ring 32 which is operative to seal the superflow diffuser and spout assembly 10 when it is attached to other components of a beverage dispensing system including a dispensing tower, as shown in FIGS. 5 and 6, which will be discussed in greater detail hereinafter.

Extending upwardly from the disk 24 and integral therewith is a cylinder 34 which fits into the dispensing tower when the superflow diffuser and spout 10 is in position for use. The cylinder 34 includes multiple screw holes 36 into which are received screws to attach the first disk 24 to a second disk, which will be described in greater detail hereinafter.

A plurality of carbonated water inlets 38 are located within the cylinder 34 and are operative to receive carbonated water from a source existing in the dispensing tower. A syrup inlet 40 is located substantially in the center portion of the cylinder 34 and is attachable to a source of syrup existing in the dispensing tower.

Also located within the body 12 is a second disk 42 which is fitted snugly within the body 12 such that minimal flow is permitted between the periphery of the disk 42 and the inside wall of the body 12. The disk 42 is provided with a plurality of channels 44 connecting a cavity 46 above the disk 42 with a cavity 48 below the disk 42. Substantially in the center portion of the disk 42 are threaded channels 50 which receive the screws (not shown) which pass through the channels 36. Thus, the first disk 24 is rigidly attachable to the second disk 42, the resulting assembly being insertable into the body 12.

In the first embodiment, the second disk 42 is provided with the numerous channels 44 which are equally spaced in a radially disposed position along the surface of the disk 42. Approximately in the center of the disk 42 is a center channel 52 which is substantially the same diameter as a channel 54 defined within the center portion of the first disk 24. Received into the channels 52 and 54 is a syrup distributor and mixing assembly, which will be described in greater detail hereinafter.

Disposed between the first disk 24 and the second disk 42 are a plurality of diffuser elements 60 which are fitted about a cylindrical downwardly extending portion 62 of the first disk 24. The diffuser elements 60 are provided with a plurality of radially disposed channels 64 which are operative to permit passage of a portion of the carbonated water from the inlets 38 through the diffuser elements 60. The diffuser elements 60 are slightly smaller in diameter than the inside diameter of the body 12 such that a small annular passage is provided between the periphery of the diffuser elements 60 and the inner wall of the body 12.

A terminal diffuser 66 is also fitted about the cylindrical portion 62. This terminal diffuser 66 does not have any channels defined along its surface. Rather, all flow must pass outside of the periphery of the terminal diffuser 66 between the outer edge of the terminal diffuser 66 and the inner wall of the body 12.

The diffusers 60 and 66 are maintained in a substantially parallel, separated alignment by the affixing of the first disk 24 to the second disk 42 by the screws (not shown). It should be appreciated that, although the first embodiment illustrates two diffuser elements 60 and a terminal diffuser 66, additional diffuser elements or other various forms of diffuser assemblies may be used without departing from the spirit of the present invention. It should also be appreciated that the diffuser elements 60 may be provided with slots, in addition to the channels, or other configurations of grooves or baffles to direct the flow of carbonated water within the chamber 46.

Fitted within the axially aligned channels 52 and 54 is a syrup distributor 70 which is operative to direct syrup from the syrup input 40 into the interior of the spout 14. The syrup distributor 70 has a substantially vertical cylindrical section 72 extending upwardly from the body 74 of the syrup distributor 70 and adapted to fit snugly into the channels 52 and 54.

The syrup distributor 70 has a channel 80 located substantially in the center of the body 74 which is in alignment with the syrup supply 40. A plurality of channels 82 open to the channel 80 are located substantially at the lower portion of the body 74 to direct the flow of syrup uniformly in multiple directions within the spout 14.

Depending on relative pressures, soda from the channel 52 may leak into the syrup in the channel 80 or vice versa. An O-ring 76 is located within a groove 78 formed along the periphery of the cylinder 72 to prevent syrup from leaking into the channel 52 or to prevent soda in channel 52 from leaking into channel 80. The O-ring 76 also assists in snugly holding the syrup distributor 70 into the cylindrical portion 62 of the first disk 24.

Extending outwardly from the body 74 is a third disk 84 which is also provided with a plurality of radially disposed and axially extending channels 86 which permit controlled and limited flow of the carbonated water from the chamber 48 into the interior chamber 88 of the spout 14.

In assembling the superflow diffuser and spout assembly of the present invention the diffuser elements 60 and terminal diffuser 66 are fitted about the cylindrical portion 62. When this is accomplished, the second disk 42 is affixed to the first disk 24 by the screws (not shown). The entire assembly consisting of the first disk 24, the diffuser elements 60, the terminal diffuser 66, and the second disk 42 is then attached to the dispensing tower by screws (not shown) from the lower side of the second disk 42. After this has been accomplished the cylinder 72 of the syrup distribution 70 is then fitted into the channels 52 and 54. The entire assembly is then covered by the body 12.

In the first embodiment of the superflow diffuser and spout assembly 10 of the present invention, the carbonated water inlet channels 38 are approximately 0.063 of an inch in diameter. In the first embodiment eight of the channels 38 are located within the cylinder 34. The channels 64 provided in the diffuser elements 60 are approximately 0.070 of an inch in diameter and number eight. The diffuser elements 60 are approximately 0.050 of an inch thick and a gap of approximately 0.030 of an inch exists between each of the diffuser elements 60. Approximately a 0.010 to 0.020 of an inch gap exists between the periphery of the diffuser elements 60 and the periphery of the terminal diffuser 66 and the inner wall of the body 12. Approximately a 0.055 of an inch gap exists between the lower surface of the terminal diffuser 66 and the upper surface of the second disk 42. The second disk 42 is provided with a plurality of channels 44 which are approximately 0.082 of an inch in diameter. The channels 86 are approximately 0.060 of an inch in diameter. It has been found that this configuration will result in flow rates of approximately 6 ounces per second at a carbonated water pressure of approximately 100 PSIG.

It should be appreciated that although the first embodiment of the present invention has been discussed in great detail above, other forms of diffusers can be located in the flow path of the carbonated water without departing from the spirit of the present invention. Consequently, although the present embodiment contemplates the use of a first disk 24, a second disk 42, a plurality of diffuser elements 60 and a terminal diffuser 66, other embodiments can be devised which accomplish the same function without departing from the spirit of the present invention.

Furthermore, other types of flow separators may be located within the cavity 48 to separate the flow of the carbonated water such that a portion of the carbonated water flows through the channels 16 and a portion of the carbonated water flows through the channels 86. Alternatively, all of the carbonated water flow can be directed either outside the spout 12 or inside the spout 12. It is the separation or direction of the flow of carbonated water within the diffuser and spout assembly which achieves the desired result not the precise configuration which results in the separated or directed flow.

The use of the superflow diffuser and spout assembly of the present invention will permit mixed soft drinks to be dispensed at flow rates of at least 6 ounces per second with a 5:1, or variable, finished drink mixture ratio of carbonated water to syrup. By varying the size and number of the channels located within the cylinder 34, the diffuser elements 60 and the second disk 42, varying flow rates can be achieved.

The operation of the superflow diffuser and spout assembly of the first embodiment of the present invention will now be discussed. It should be appreciated that the superflow diffuser and spout assembly of the present invention includes a diffuser of a unique design such that it drops the pressure of the carbonated water in a series of multiple stages.

The carbonated water initially enters the first disk 24 through the channels 38. A first pressure drop occurs within the channels 38. As the carbonated water flows through the channels 38 it enters the upper portion of the cavity 46 above the first diffuser element 60 wherein another pressure drop occurs. The carbonated water then passes through the channels 64 which function as capillaries to permit passage of a portion of the carbonated water through the diffuser elements 60. These channels 64 provide another stage of pressure reduction and their diameter and number may be varied depending upon the exact flow rate range and pressure reduction that is to be achieved.

Another stage of pressure reduction occurs as the carbonated water passes through a number of small chambers that are located between the diffuser elements 60 and the terminal diffuser 66. A portion of the carbonated water is allowed to flow radially outward where it must pass through several restricted annular spaces created between the periphery of the diffuser elements 60 and the terminal diffuser 66 and the inner wall of the body 12. Since there are no channels located within the terminal diffuser 66 all carbonated water passes between the periphery of the terminal diffuser 66 and the inner wall of the body 12. This passage of carbonated water around the terminal diffuser 66 effectuates additional reduction in pressure of the carbonated water.

Another unique feature is that a cross-current effect occurs within the diffuser section. This cross-current effect occurs because a portion of the carbonated water will pass through the channels 64 and a portion of the carbonated water will flow outwardly along the upper surfaces of the diffuser elements 60 and the terminal diffuser 66. As the carbonated water passes through the channels 64 it strikes the upper surface of the terminal diffuser 66 and is redirected back through the channels 64 thus increasing the cross-current effect and flooding the cavity 46. Furthermore, the stream of carbonated water flowing radially along the upper surface of the diffuser elements 60 and terminal diffuser 66 will collide with the flow of carbonated water passing along the inside wall of the body 12 to create additional pressure reduction. Because of this cross-current effect, additional substantial pressure drop occurs within the diffuser section of the present invention.

When the flow of carbonated water about the outside edges of the diffuser elements 60 meets the outward flow along the top of the terminal diffuser 66, additional pressure drop is provided. The diameter of the diffuser elements 60 and 66 preferably have the same O.D. dimension to occasion a balancing of the flow.

To further dissipate the velocity of the carbonated water, as the carbonated water passes around the edge of the terminal diffuser 66, the carbonated water is allowed to expand into the lower portion of the chamber 46 between the terminal diffuser 66 and the second disk 42. In this manner the carbonated water floods the lower portion of the chamber 46. The carbonated water then drops through the large number of channels 44 defined within the second disk 42. In the first embodiment it should be pointed out that the areas between the first disk 24 and the diffuser elements 60 and the terminal diffuser 66 are smaller than the area between the terminal diffuser 66 and the second disk 42. It has been determined that this results in a more balanced flooding of all areas between the diffuser elements 60 and the terminal diffuser 66.

Another stage of pressure drop occurs as the carbonated water passes through the multitude of channels 44 in the second disk 42. By sizing the channels 44 in accordance with desired flow rates and carbon dioxide retention, pressure drop of the carbonated water may be controlled. Yet another stage of pressure drop occurs as the carbonated water passes through the channels 44 and into the cavity 48. At this point the carbonated water is separated into two streams which occasions additional pressure drop. A first stream flows through the channels 16 defined within the lower portion of the body 12 and located about the spout 14. A second portion of the stream is diverted through the channels 86 defined within the disk 84 and is allowed to flow into the chamber 88 within the spout 14. Thus, another stage of pressure drop is achieved by passage of the carbonated water through the channels 16 and through the channels 86 into the chamber 88. Alternatively, all of the carbonated water flow may be directed to the outside of the spout 14 or into the spout 14. The gradual reduction of pressure and velocity of the carbonated water stream is essential to minimizing foaming and maximizing the carbonation retention level of the finished drink.

It should be appreciated that in the first embodiment a greater volume of carbonated water is permitted to pass through the channels 16 than through the channels 86. It has been determined that only a small portion of the carbonated water need pass through the channels 86 and into the inner portion of the spout 14 to effectuate proper mixing with the syrup dispensed by the syrup distributor 70 in many circumstances. The blending that occurs within the interior of the spout 14 in the chamber 88 is the first stage of carbonated water/syrup mixing and results in little foaming since only a small quantity of the carbonated water is allowed to gently mix with the syrup. The configuration of the spout 14 permits another stage of pressure drop to occur as the carbonated water enters the chamber 88. The carbonated water also rinses the spout 14 and thus cleans the chamber 88 of any residual syrup.

The body 12 and spout 14 configuration is also of unique design. The body 12 and spout 14 configuration allows most of the carbonated water, at the time that it passes through the channels 16 and meets the carbonated water flowing through the spout 14, to be substantially at atmospheric pressure. The channels 16 are larger than the channels 44 located within the second disk 42 but there are fewer of the channels 16 located about the periphery of the spout 14. These channels 16 allow the carbonated water to be broken up into many large streams that flow on the outside surface of the spout 14 and cling to the surface of the spout 14. To assist in the clinging of the stream to the spout 14, the spout 14 may be provided with a set of very fine serrations (not shown) along the outer surface of the spout 14. These serrations assist in causing the stream of carbonated water to follow closely to the surface of the spout 14. However, it should be appreciated that the serrations are not necessary. The spout 14 may be constructed with the grooves 18 and 20 described below.

The spout 14 is designed such that a further reduction in the flow energy of the carbonated water is occasioned as the carbonated water leaves the second disk 42 and fills the area between the second disk 42 and the floor of the pouring spout 14. At the bottom of the spout 14, some of the water/syrup mixture collides with the streams of water coming down along the outside of the spout 14 through the channels 16, thus reducing the energy of the carbonated water.

As the carbonated water streams through the channels 16 of the body 12, the velocity of the water stream is further reduced by grooves 18 and 20 located just below the channels 16 of the body 12. These grooves 18 and 20 allow the many streams along the outside periphery of the spout 14 to blend into a single solid stream around the full periphery of the spout 14. This blending into a single stream eases the mixing of the syrup and carbonated water at the bottom of the spout 14.

The channels 16 also allow the carbon dioxide that has escaped, as a result of the lowering of the pressure of the carbonated water, to vent to the atmosphere without contacting the syrup. Thus, the foaming of the end product is substantially reduced, carbon dioxide contacting the syrup, along with relative velocity between the carbonated water and the syrup when mixed, being a major cause of foaming.

A further advantage is that a small amount of the carbon dioxide is lost to the atmosphere and is thus prevented from mixing with the syrup as the carbonated water flows down the outside of the spout 14. Also, the stream flowing along the outside of the spout 14 is slowed by the surface of the spout 14 departing from conventional spout assemblies which provide limited contact with the stream of carbonated water. Also, as the stream passes through the channels 16 and along the outside of the spout 14 it converges and blends with the carbonated water/syrup stream flowing through the chamber 88 and additional mixing is occasioned at the lower portion of the spout 14. Thus, dilution of the concentrated carbonated water/syrup stream by the first water stream passing along the outside of the spout 14 is done and the resultant confluence of the first stream and the second stream results in a gentle blending of the streams and additional mixing of the syrup with the carbonated water to result in a higher quality drink.

A second embodiment of the present invention illustrates a superflow diffuser and spout assembly 110 that is designed to be used with a plurality of different flavored syrups. In this second embodiment the superflow diffuser and spout assembly 110 includes a syrup distributor 112 which has a plurality of channels 114 which are operative to introduce different flavored syrups into the interior of the spout 120. The syrups are dispensed through a series of independent channels 122 which are spaced apart and thus permit dispensing of different flavors of syrup through one syrup distributor 112.

The superflow diffuser and spout assembly 110 includes a special shroud 130 which is fitted into the inner portion of the spout 120 and is retained within the spout 120 by locating the shroud 130 about the periphery of the syrup distributor 112. Retaining the shroud 130 within the spout 120 is accomplished by the use of an O-ring 132 located within a groove 134. The shroud 130 has a plurality of channels 136 defined substantially within its upper portion to permit the introduction of carbonated water into the cavity 13 located between the outer periphery of the syrup distributor 112 and the inner wall of the shroud 130. A small annular channel 140 is present between the outer wall of the shroud 130 and the inner wall of the spout 120.

In this second embodiment the syrup distributor 112 has an outwardly extending terminal diffuser 142 integral with the syrup distributor 112. A plurality of diffuser elements 144 containing channels 146 are located between the terminal diffuser 142 and the first disk 148. The first disk 148 includes a series of channels 150 which are operative to introduce carbonated water into the cavity 152.

A second disk 154 containing a plurality of channels 156 is fitted below the terminal diffuser 142 and defines a second chamber 158 which opens into a plurality of channels 160, whereby the flow of carbonated water through the superflow diffuser and spout assembly 110 is diverted into two streams, one stream passing through the plurality of channels 160, the other stream passing through the plurality of channels 136.

The shroud 130 has a recessed portion 162 which defines a chamber 164 which results in a slightly longer "after-flow" to accomplish rinsing of the syrup from the mixing area to minimize flavor carryover. A controlled and limited portion of the carbonated water will flow through the channels 136 thus resulting in mixing of the carbonated water with the syrup flowing through the channels 122. An even smaller portion of the carbonated water will flow into the annular channel 140 between the outer periphery of the shroud 130 and the inner wall of the spout 120. This annular channel 140 carries a small portion of the carbonated water, without being mixed with the syrup, to effectuate rinsing of the pouring spout 120. The close fit between the shroud 130 and the spout 120, permitting only limited flow, is effective to wash away any remaining syrup residue on the bottom edge of the shroud 130.

In the superflow diffuser and spout assembly 110 of the second embodiment, a similar number of pressure drops are occasioned by the use of multiple chambers, diffuser elements and channels as in the first embodiment. Thus, the resulting carbonated water passing through the channels 160 is substantially at atmospheric pressure at the time that it passes along the outside of the spout 120 and mixes with the blended carbonated water/syrup mixture flowing through the shroud 130 and spout 120.

A shroud may be used with the single flavor superflow diffuser and spout assembly 10 whereby the shroud can be located within the spout 14 to occasion washing of the spout of any residual syrup and reduction in the velocity of the distributed syrup resulting in a more gentle mixing of the syrup and carbonated water to reduce foaming. Furthermore, it should be appreciated that various configurations of channels may be located about the outside of the spout in either the first embodiment or the second embodiment to control the flow of carbonated water on the outside of the spout and thus vary the flow rate and mixing of the carbonated water/-syrup.

Figure 3:
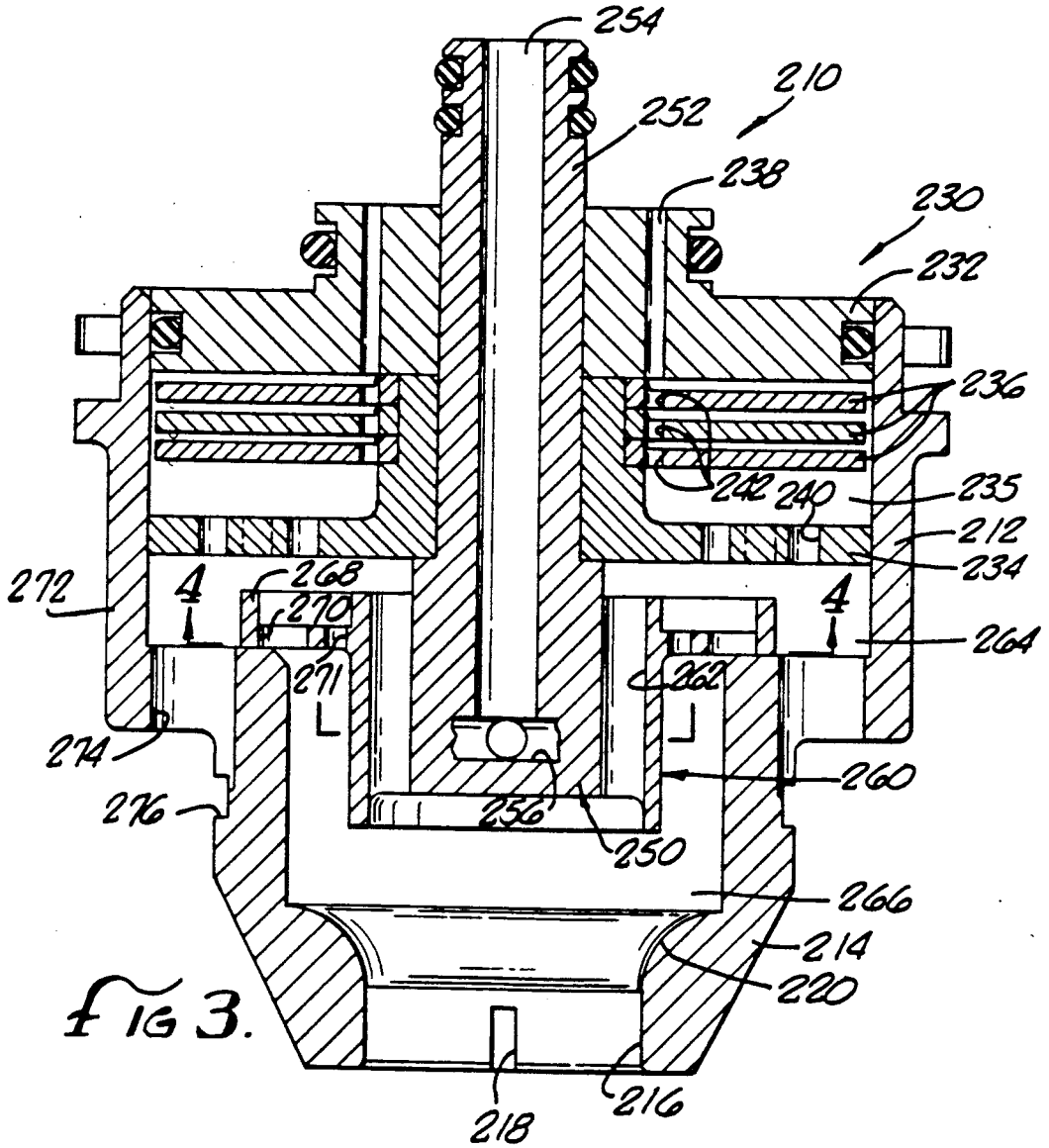
FIG. 3 is a side cross-sectional view of a third embodiment of the superflow diffuser and spout assembly of the present invention.
Figure 4:
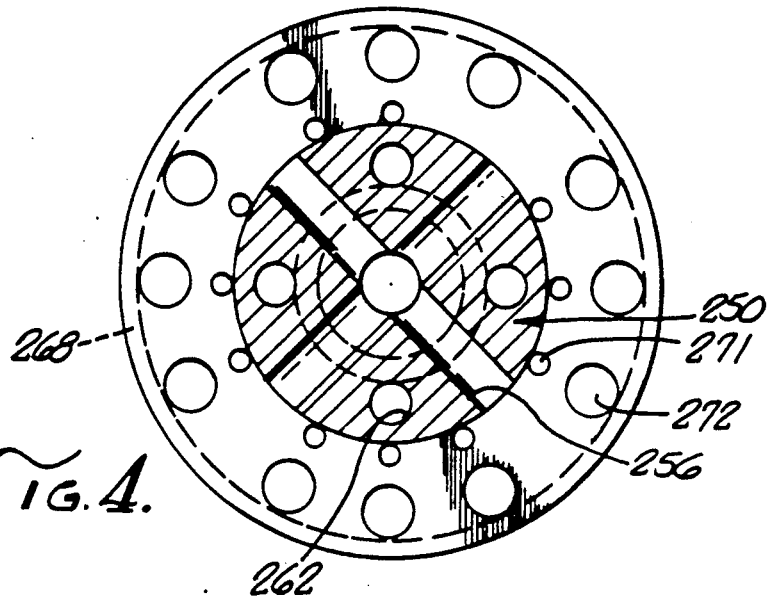
FIG. 4 is a lower elevation view of the third embodiment of the superflow diffuser and spout assembly of the present invention.

A third embodiment of the superflow diffuser and spout assembly of the present invention is shown in FIGS. 3 and 4 and is identified generally with numeral 210. The assembly 210 includes a body 212 which has a downwardly extending spout 214 integral therewith. The spout 214 has an opening 216 defined at one end and a slot 218 is cut into the wall of spout 214. The lower inner surface 220 of the spout 214 is convexly shaped to result in an improved discharge of fluid through the spout 214.

A diffuser assembly, identified generally with the numeral 230, is sized to fit within the body 212. The diffuser assembly 230 includes an upper disk 232 and a lower disk 234. Between the upper disk 232 and the lower disk 234 there are a plurality of diffuser elements 236 which are spaced apart from each other. A plurality of diluent inlets 238 is provided in the disk 232 and a plurality of diluent outlets 240 is provided in the disk 234. There is also a plurality of channels 242 provided in the elements 236, the channels 242 being located substantially in the center portion of the elements 236.

A syrup distributor, identified generally with the numeral 250, is located substantially in the center of the body 212. The syrup distributor 250 passes substantially through the center of the diffuser assembly 230 and has an upper portion 252, which includes a syrup inlet 254. At the lower portion of the syrup distributor 250, there are a plurality of syrup distribution ports 256 which are adapted to distribute syrup into the inner portion of the spout 214.

Also included within the body 212 is a flow separator, identified generally with the numeral 260, which includes a plurality of surfaces which are operative to separate flow within the assembly 210. The flow separator 260 includes a plurality of channels 262 which permit flow of fluid within the assembly 210 from the chamber 264 into the chamber 266.

The flow separator 260 also includes a radially extending portion 268, which includes a plurality of channels 270 and 271 which are operative to permit flow from the chamber 264 into the chamber 266. Between the outer wall 272 of the body 212 and the spout 214 there are a plurality of channels 274 which permit flow of fluid from the chamber 264 to the outside of the assembly 210. There is a groove 276 defined along the outer surface of the spout 214 and positioned below the channels 274.

A bottom view of the radially extending portion 268 and syrup distributor 250 is shown in FIG. 4. The radially extending portion 268 includes spaced channels 271 and spaced channels 272. The channels 262 within the syrup distributor 250 and the syrup distribution ports 256 are also shown.

In the third embodiment of the superflow diffuser and spot assembly of the present invention, the upper disc inlets 238 are approximately 0.070 inches in diameter and there are eight of such inlets; the diluent outlets 240 are approximately 0.082 inches in diameter; and the channels 242 located in the elements 236 are approximately 0.093 inches in diameter. In the flow separator 260, the channels 270 are approximately 0.136 inches in diameter and the channels 271 are approximately 0.067 inches in diameter.

The operation of the superflow diffuser and spout assembly 210 of the third embodiment of the present invention is similar to the operation of the superflow diffuser and spout assemblies 10 and 110. In operation, a diluent, such as carbonated water, is introduced through the channels 238 into the diffuser assembly 230. The diluent flows into the chamber 235, in which the diffuser elements 236 are located. The diluent passes through the channels 242 and in the space between the outer periphery of the diffuser elements 236 and the inner wall of the body 212. The diluent then flows from the chamber 235 through the channels 240 in the second disk 234 and into the chamber 264. Once in the chamber 264, the diluent is separated into a plurality of flows, one of the flows flowing through the channels 274 to the outside of the apparatus 210, the other of the flows being separated into subflows which pass through the channels 270 and 271. A certain portion of the diluent flow also passes through the channels 262 and directly into the chamber 266. The syrup passing through the ports 256 mixes with the flow of diluent passing through the channels 270 and 271 and eventually mixes with the diluent passing through the channels 262. Thus, within the chamber 266 there is substantial mixing between the syrup and the diluent. After this preliminary mixing has occurred, the mixture consisting of syrup and diluent then passes through the opening 216 in the spout 214.

The superflow diffuser and spout assemblies 10, 110 and 210 of the present invention are useful with a complete beverage distribution system. A representative block diagram of components of a beverage distribution system is illustrated in FIGS. 5 and 6. Briefly, the beverage distribution system, referred to generally with the numeral 310, consists of a plurality of bag-in-box syrup storage containers 312 and a plurality of mount pumps 314 in fluid communication with the bag-in-box containers 312. There is also included a gas tank 316 and a plurality of regulators 318. The gas tank 316 is in fluid communication with the regulators 318 and with the mount pumps 314. The mount pumps 314 are also in fluid communication through a plurality of syrup outlet lines 320 with a dispensing tower 322. The gas tank 316 is also in fluid communication with a carbonator, generally designated with the numeral 330, through a line 324. The carbonator 330 is in fluid communication with a water supply and in fluid communication with the dispensing tower 322, the carbonator having a water line 326 extending between the carbonator 330 and the tower 322 and a plurality of soda lines 328 extending between the carbonator 330 and the tower 322.

The components of the dispensing tower 322 are shown generally in FIG. 6. The superflow diffuser and spout assembly 10, 110 and 210 of the present invention is attachable to the other components of the dispensing tower 322 by fitting the superflow diffuser and spout assembly 10, 110 and 210 through an aperture defined within a base plate 412. The base plate 412 is attached to a front block 414 which includes a mounted solenoid bracket 416 which in turn contains a solenoid 418. Common electrical circuitry and connections 420 are included with the solenoid 418.

An actuation lever 422 is rotatably attached to the front block 414; the lever 422 intended to be used by the operator to control the filling cycle. The front block 414 is attached to a back block 424 which contains a syrup outlet 426 and carbonated water outlet 428. A locking mechanism 430 is provided with the back block 424 to rigidly affix the front block 414 to the back block 424. The back block 424 is rigidly affixed to the other cabinetry included with the dispensing tower 322. An external syrup supply line 432 and an external carbonated water supply line 434 are engageable with the back block 424 to provide a source or supply of syrup and carbonated water to the dispensing tower 322.

A fourth embodiment of the superflow diffuser and spout assembly of the present invention is shown in FIG. 7 and is identified generally with numeral 510. The assembly 510 includes a body 512 which has a downwardly extending spout 514 integral therewith. The spout 514 has an opening 516 defined at one end and a slot 518 is cut into the wall of the spout 514. The lower inner surface 520 of the spout 514 is convexly shaped to result in an improved discharge of fluid through the spout 514.

A diffuser assembly, identified generally with the numeral 530, is sized to fit within the body 512. The diffuser assembly 530 includes an upper disk 532 and a lower disk 534 defining a chamber 535. Between the upper disk 532 and the lower disk 534 there are a plurality of diffuser elements 536 in the chamber 535 which are spaced apart from each other. A plurality of diluent inlets 538 is provided in the disk 532 and a plurality of diluent outlets 540 is provided in the disk 534. There is also a plurality of channels 542 provided in the elements 536, the channels 542 being located substantially in the center portion of the elements 536.

A syrup distributor, identified generally with the numeral 550, is located substantially in the center of the body 512. The syrup distributor 550 passes substantially through the center of the diffuser assembly 530 and has an upper portion 552, which includes a syrup inlet 554. At the lower portion of the syrup distributor 550, there are a plurality of syrup distribution ports 556 which are adapted to distribute syrup laterally outwardly into the interior of the spout 514.

Also included within the body 512 is a flow separator, identified generally with the numeral 560, which includes a plurality of surfaces which are operative to separate flow within the assembly 510. The flow separator 560 includes a plurality of channels 562 which permit flow of fluid within the assembly 510 from a chamber 564 between the disk 534 and the flow separator 560 into a chamber 566 below the flow separator 560.

The flow separator 560 also includes a radially extending portion 568, which includes a plurality of channels 570 and 571 which are operative to permit flow from the chamber 564 into the chamber 566. The channels 571 and 572 are located such that they are not aligned with the ports 556 of the diffuser. In this way, the flow of diluent does not directly impinge on the streams of syrup exiting the ports 556. Between an outer wall 572 of the body 512 and the spout 514 there are a plurality of channels 574 which permit flow of fluid from the chamber 564 to the outside of the assembly 510. There is a groove 576 defined along the outer surface of the spout 514 and positioned below the channels 574.

Located through the wall of the spout 514 about its periphery are holes 578. These holes 578 are misaligned with the ports 556 in order that pressurized syrup cannot squirt from a port 556 and directly through a hole 578. Instead, the syrup impacts against the inside wall of the spout 514. A channel 580 is established in the inner wall of the spout below the level of the ports 556. Thus, the channel 580 is able to receive at least a portion of the syrup squirting outwardly from the ports 556 for distribution thereof about the periphery of spout 514 at the inner wall. The channel 580 intersects the holes 578 such that syrup collected in the channel 580 is released through the wall of the spout 514 to join the carbonated water stream flowing along the outer surface of the spout 514. To achieve a flow of syrup to both the inside stream of diluent and the outside stream of diluent, the channel 580, holes 578 and ports 556 are preferable sized and the syrup pressure controlled such that the syrup will overflow the channel 580 and/or splash off the inner wall of the spout 514. Empirical testing is best used to accomplish the correct ratio of flow division between the syrup flowing outwardly of the spout and the syrup flowing through the spout passageway. As can be seen in FIG. 7, the holes 578 are advantageously arranged to completely drain the channel 580 so that residual syrup does not remain.

The operation of the superflow diffuser and spout assembly 510 of the fourth embodiment of the present invention is similar to the operation of the superflow diffuser and spout assemblies !0 and 110. In operation, a diluent, such as carbonated water, is introduced through the channels 538 into the diffuser assembly 530. The diluent flows into the chamber 535, in which the diffuser elements 536 are located. The diluent passes through the channels 542 and in the space between the outer periphery of the diffuser elements 536 and the inner wall of the body 512. The diluent then flows from the chamber 535 through the channels 540 in the second disk 534 and into the chamber 564. Once in the chamber 564, the diluent is separated into a plurality of flows, one of the flows flowing through the channels 574 to the outside of the apparatus 510, the other of the flows being separated into subflows which pass through the channels 570 and 571. A certain portion of the diluent flow also passes through the channels 562 and directly into the chamber 566. A portion of the syrup passing through the ports 556 mixes with the flow of diluent passing through the channels 570 and 571 and eventually mixes with the diluent passing through the channels 562. Thus, within the chamber 566 there is substantial mixing between the syrup and the diluent. After this preliminary mixing has occurred, the mixture consisting of syrup and diluent then passes through the opening 516 in the spout 514. A portion of the syrup also mixes with the diluent passing along the outside of the spout 514. This portion is that collected by the channel 580 and passed through the holes 578. The early mixing of the syrup with the diluent, normally carbonated water, flowing both through the spout 514 and outside thereof is advantageous when the two components do not have a chance to adequately mix below the spout. Such a situation can exist when the flow is immediately received by a cup filled with ice which inhibits mixing in the cup.

It will be obvious to those skilled in the art that various changes may be made without departing from the spirit of the present invention, and therefore the invention is not limited to what is shown in the drawings and described in detail in this specification but only as indicated in the appended claims.

What is claimed is:

1. A superflow diffuser and spout assembly for use with a liquid dispensing apparatus dispensing a syrup and a diluent, comprising a body having a cavity extending therethrough, a diluent inlet in said body for receiving a supply of the diluent into said cavity;

a syrup inlet in said body for receiving a supply of the syrup;

a diffuser assembly in said cavity through which at least a portion of the diluent supply passes prior to being dispensed;

a spout depending from said body having a passageway therethrough in communication with said cavity, said passageway having holes extending outwardly through the wall of said spout;

a flow separator within said cavity to divide the flow of the diluent supply therethrough;

passages to direct a portion of the divided diluent flow to the outer surface of said spout;

a syrup distributor in said spout having ports oriented to direct syrup outwardly for direct impingement on the inner wall of said spout above said holes.

2. The superflow diffuser and spout assembly of claim 1 wherein said spout further includes an upwardly facing channel about the inner periphery of the wall of said spout, said channel being in communication with said holes through the wall of said spout.

3. The superflow diffuser and spout assembly of claim 2 wherein said channel is located below said ports in said syrup distributor.

* * * * *